US005480230A

United States Patent [19]

May

[11] Patent Number: 5,480,230

[45] Date of Patent: Jan. 2, 1996

[54] DOUBLE HEADER PACKAGE HAVING A TEAR BEAD

[75] Inventor: Timothy J. May, Greenville, Wis.

[73] Assignee: Reynolds Consumer Products Inc., Appleton, Wis.

[21] Appl. No.: 225,865

[22] Filed: Apr. 11, 1994

[51] Int. Cl.[6] ..... B65D 33/14; B65D 33/25

[52] U.S. Cl. ..... 383/9; 383/61; 383/66; 383/63; 383/206

[58] Field of Search ..... 383/9, 61, 66, 383/63, 120, 203, 205, 206

[56] References Cited

U.S. PATENT DOCUMENTS

| | | | |
|---|---|---|---|
| 2,878,849 | 3/1959 | Lingenfelter et al. | 383/9 |
| 3,101,887 | 8/1963 | Kugler . | |
| 3,249,288 | 5/1966 | Repko | 383/66 X |
| 3,462,070 | 8/1969 | Corella . | |
| 3,519,197 | 7/1970 | Campbell | 383/66 X |
| 3,616,991 | 11/1971 | Beck | 383/9 X |
| 3,889,871 | 6/1975 | White . | |
| 3,990,627 | 11/1976 | Olson . | |
| 4,252,238 | 2/1981 | Spiegelberg et al. | 383/66 X |
| 4,290,467 | 9/1981 | Schmidt | 383/9 |
| 4,410,130 | 10/1983 | Herrington . | |
| 4,428,477 | 1/1984 | Cristofolo | 383/203 X |
| 4,570,820 | 2/1986 | Murphy | 383/66 X |
| 4,615,045 | 9/1986 | Siegel | 383/9 X |
| 4,786,190 | 11/1988 | Van Erden et al. | 383/66 X |
| 4,848,928 | 7/1989 | Ausnit | 383/63 X |
| 4,925,318 | 5/1990 | Sorensen . | |
| 4,941,307 | 7/1990 | Wojcik | 383/63 X |
| 4,944,409 | 7/1990 | Busche et al. . | |
| 4,969,967 | 11/1990 | Sorensen et al. . | |
| 5,022,530 | 6/1991 | Zleke . | |
| 5,036,643 | 8/1991 | Bodolay | 383/9 X |
| 5,118,203 | 6/1992 | Andronlco . | |
| 5,129,734 | 7/1992 | Van Erden | 383/9 X |
| 5,186,543 | 2/1993 | Cochran . | |
| 5,215,380 | 6/1993 | Custer et al. . | |
| 5,226,734 | 7/1993 | Scott et al. | 383/63 X |

FOREIGN PATENT DOCUMENTS

| | | | |
|---|---|---|---|
| 0099965 | 4/1989 | Japan | 383/63 |
| 0240650 | 10/1991 | Japan | 383/66 |
| 093012008A | 6/1993 | WIPO | 383/120 |

*Primary Examiner*—Jes F. Pascua
*Attorney, Agent, or Firm*—Alan T. McDonald

[57] ABSTRACT

A packaging arrangement providing greater area for the incorporation of graphics without unduly increasing the package size and for optionally providing a structure for hanging the package without interfering with the ability to gain access to the contents of the package comprising a primary header, a secondary header, a containment section, a tear bead located within said secondary header to assist in opening the packaging arrangement, a recloseable system to permit the packaging arrangement to be reclosed after it has been opened, and optionally a hang hole located in the primary header.

22 Claims, 3 Drawing Sheets

Fig. 1
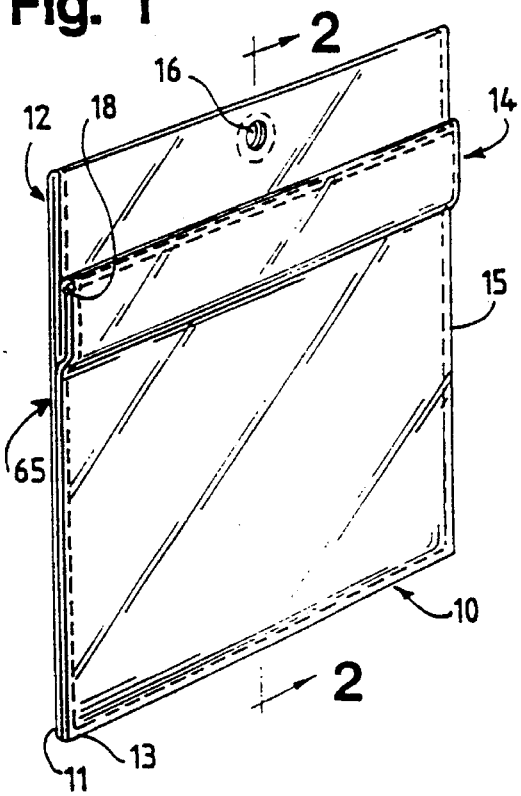
Fig. 2
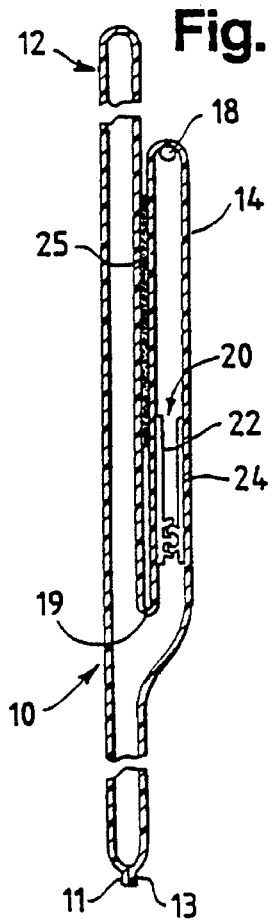
Fig. 5
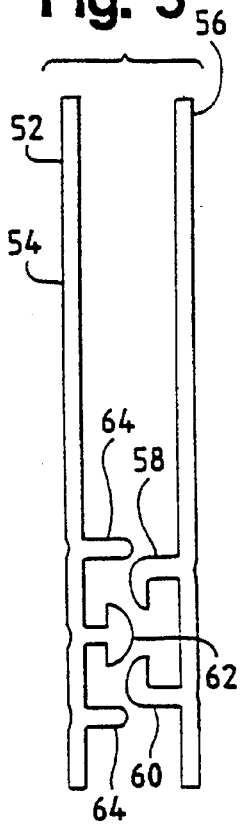
Fig. 3
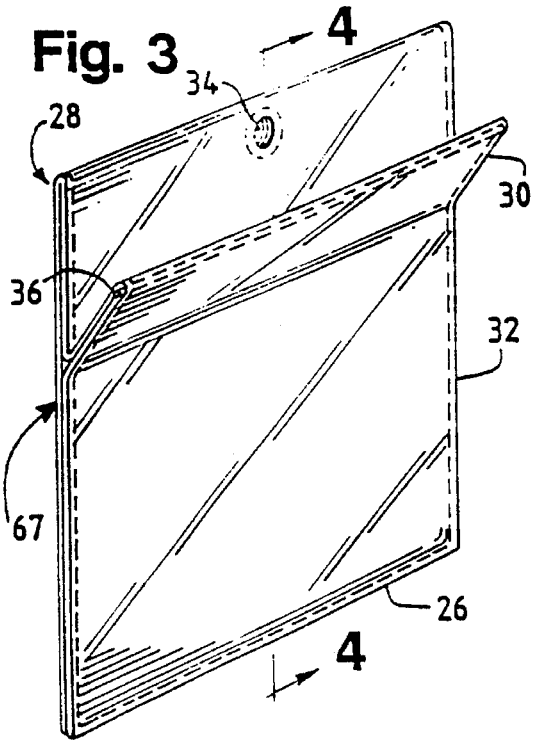
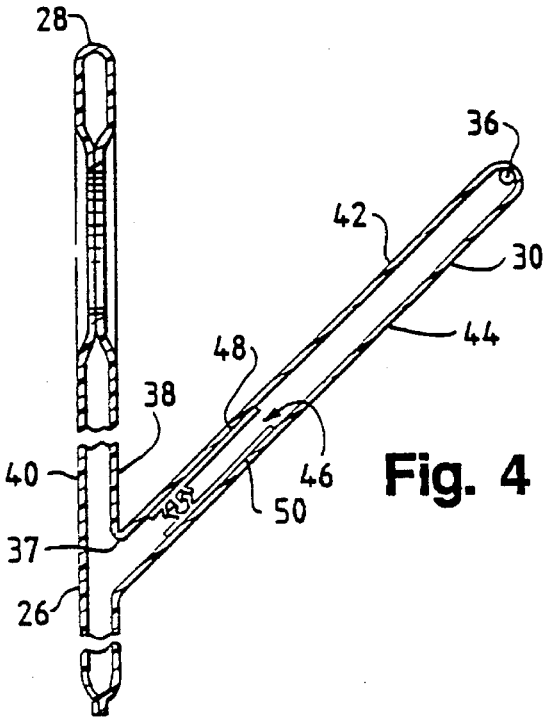
Fig. 4

DOUBLE HEADER PACKAGE HAVING A TEAR BEAD

FIELD OF THE INVENTION

The present invention generally relates to packaging arrangements for polymeric (plastic) bags and, more particularly, relates to a packaging arrangement having a double header and a tear bead.

In many consumer packaging applications, it is important to prevent air or water or the like from passing out of or into a package containing certain products. This is particularly true with respect to meat packages, cheese packages, and the like, for which the contained product must be kept in a constant environment to prevent spoilage. In order to preserve the product contained within such a package, the periphery of the package must be hermetically sealed. Hermetic seals can be provided by both permanent seals and temporary seals known as peelable seals.

It is also desirable to provide a convenient and effective way to reseal the package after it has been opened. In this respect, recloseable zipper seals are advantageous. On the other hand, recloseable seals alone provide an opportunity for undesired tampering with the contents of a package. To reduce the opportunity for undetected tampering, packages with recloseable zippers can be permanently sealed above or below the recloseable zipper in such in manner that the opening of the package becomes apparent.

However, seals which inhibit tampering may be difficult for the consumer to open. To overcome this problem, a tear bead can be combined with a recloseable zipper to provide a package which is easy for the consumer to open and reseal and yet minimizes the opportunities for undetected pre-sale product tampering.

In addition to the desirable packaging characteristics described above, from the perspective of a retailer and/or manufacturer it is also important to provide means for effectively displaying a product. To this end, hang holes in the top in product packaging may be utilized to permit arrangement of such packaging vertically in display panels or refrigerated units.

However, a problem exists in combining in a single package a hang hole which is useful for display purposes with a tear bead which is helpful in opening the package. In order to provide a hermatically sealed package, the edges of hang holes are typically sealed. The existence of a hang hole in the path between the area where the package is opened and the area where the contents of the package are contained makes it difficult to access the contents of a package because the seal around the hang hole must be broken. Thus even if a tear bead is provided to assist in opening the package, the presence of a hang hole in the path between the opening created by the tear bead and the contents of the package can present an obstacle to accessing the contents.

Additionally, from the perspective of a manufacturer, it is advantageous to increase the packaging surface area on which graphics and/or product information can be incorporated. However, in many instances increasing the overall package size can be disadvantageous; for example by increasing shipping costs or decreasing the amount of merchandise that a retailer can display in a given display area. Thus, there is a need for a package which provides a greater surface area for graphics and product information without unduly increasing the overall package size.

A need exists for a closure arrangement for a polymeric bag which overcomes the aforementioned shortcomings associated with existing packaging arrangements and incorporates the enumerated desirable characteristics.

SUMMARY OF THE INVENTION

In one particular embodiment, these and other objects are realized by providing a packaging arrangement which has a primary header, a secondary header with an attached tear bead to assist in opening the packaging arrangement, a containment section, and a recloseable system to permit the bag to be reclosed after it has been opened. In a preferred embodiment the recloseable system comprises a recloseable zipper. The primary and secondary headers are joined at a juncture between the two headers and the containment section is located below this juncture. The recloseable zipper may be located either within the secondary header or within the containment section. The secondary header may permanently engage, releasably engage, or not engage the primary header above the juncture between the two headers. Graphics and textual information on the infold sides of the primary and secondary headers may most effectively be observed when the secondary header does not engage or releasably engages the primary header above the juncture between the two headers. Finally, a hang hole may be provided to assist in hanging the package for storage or for display reasons without interfering with the accessibility of the contents of the package by locating the hang hole in the primary header while the tear bead is located in the secondary header.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which:

FIG. 1 is a perspective view of a recloseable bag according to a preferred embodiment of the present invention;

FIG. 2 is a sectional view of the embodiment of FIG. 1 taken generally along the line 2—2.

FIG. 3 is a perspective view of a recloseable bag according to another preferred embodiment of the present invention;

FIG. 4 is a sectional view of the embodiment of FIG. 3 taken generally along the line 4—4;

FIG. 5 is a cross-sectional view of a recloseable zipper;

Figure 6:
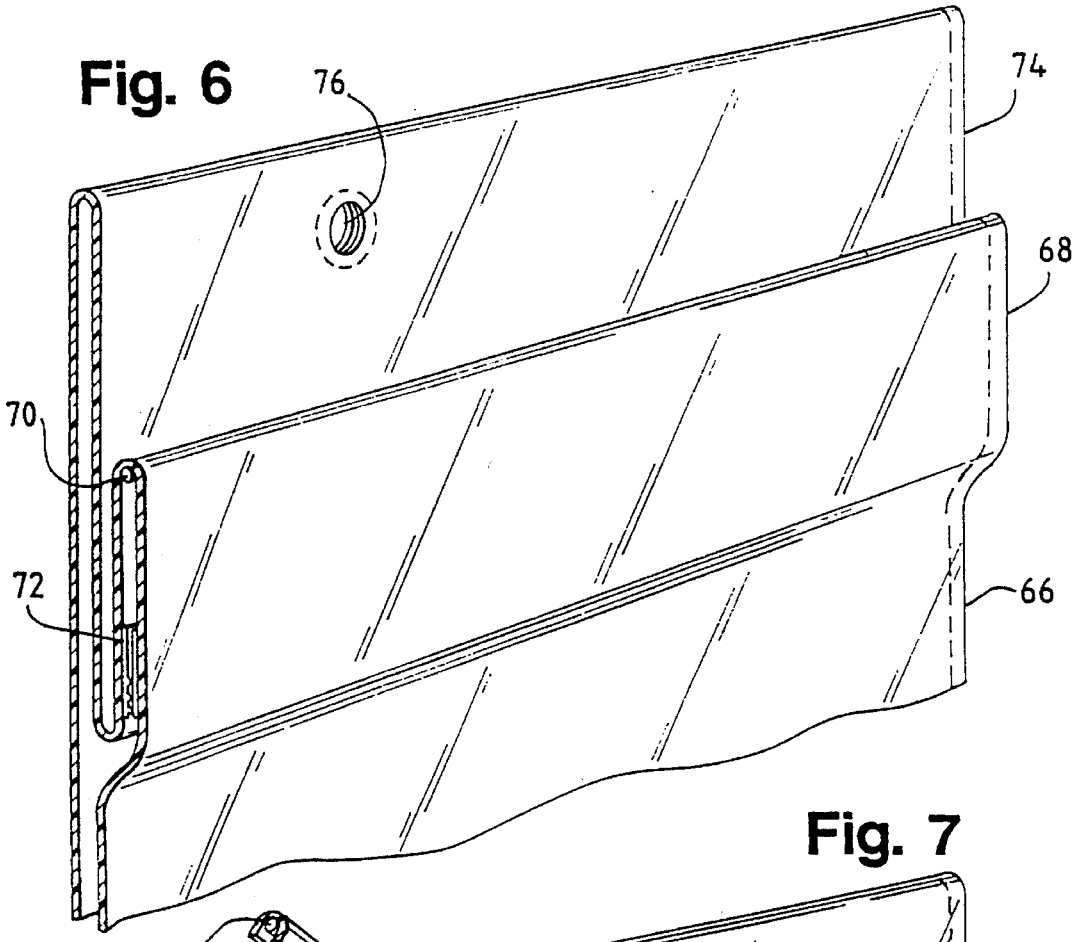
FIG. 6 is a perspective view of a recloseable bag prior to the seal of the secondary header being broken.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings, FIG. 1 is a recloseable bag 10 according to a preferred embodiment of the present invention. As shown in FIG. 1, the bag 10 comprises a single web of thermoplastic film, having a leading edge 11 and a trailing edge 13, which is folded so as to form a primary header 12 and a secondary header 14. The bag 10 additionally comprises a containment section 15. A hang hole 16 is located in the primary header 12. The hang hole 16 provides a means by which the bag 10 may be hung in a display rack.

To assist in opening the bag 10, a tear bead 18 is positioned inside and near the top of the secondary header 14. A recloseable system (see FIG. 2) is also located within the secondary header 14. The side edges of the primary header 12 are heat sealed together as are the side edges of the secondary header 14. Likewise the edges of the bottom of the bag 10 are heat sealed as is the area surrounding hang hole 16. These heat seals hermatically seal the bag 10. In the preferred embodiment of FIG. 1, the side edges of the secondary header 14 are heat sealed to the side edges of the primary header 12.

By locating the hang hole 16 in the primary header 12 and locating the tear bead 18 in the secondary header 14, the presence of the hang hole 16 does not interfere with the accessibility to the contents of the package.

FIG. 2 is a sectional view of the embodiment of FIG. 1 taken generally along the line 2—2. The recloseable bag 10 comprises a primary header 12 and a secondary header 14, the primary header 12 and secondary header 14 being joined at a juncture 19. A leading edge 11 and a trailing edge 13 are indicated at the bottom of bag 10. A tear bead 18 is heat sealed to the inside surface of the secondary header 14 near the top. The tear bead 18 is preferably made of a high density polyethylene chord surrounded by a low temperature sealant such as a ehtylene vinyl acetate (EVA) type material such as ESCORENE® manufactured by Exxon Chemical Co. of Baytown, Tex. A recloseable system depicted as a recloseable zipper 20 is located near the bottom of the secondary header 14. The recloseable zipper 20 comprises a pair of profiles 22 and 24 which are heat sealed to opposing inside surfaces of the secondary header 14.

While the bag 10 in the preferred embodiment of FIGS. 1 and 2 is formed of a single web of thermoplastic film; in an alternate embodiment the bag is manufactured of more than one web of film and/or more than one type of film. For example, the primary and secondary headers may be manufactured from two different types of thermoplastic film. Furthermore, the engagement between the primary header 12 and the secondary header 14 need not be at or solely at their respective edges; but rather, the area of engagement may be, for example, along the length of the headers 12 and 14.

Figure 8:
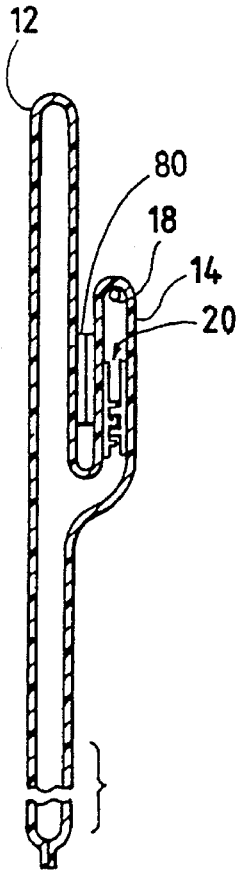
FIG. 8 is a sectional view of the embodiment of FIG. 1 taken generally along the line 2—2 illustrating use of a peelable seal between a primary and a secondary header according to a preferred embodiment of the present invention.
Figure 9:
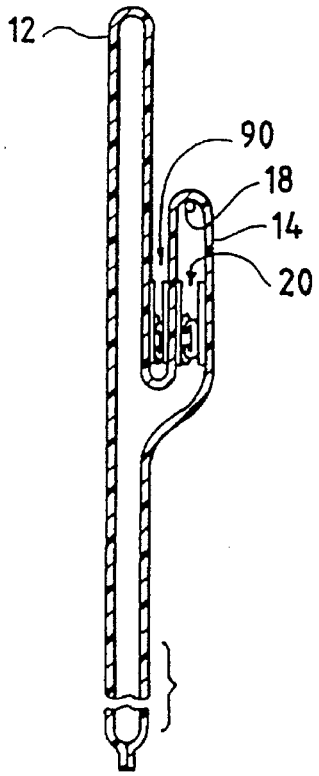
FIG. 9 is a sectional view of the embodiment of FIG. 1 taken generally along the line 2—2 illustrating the use of a reclosable zipper between a primary and a secondary header according to a preferred embodiment of the present invention.
Figure 10:
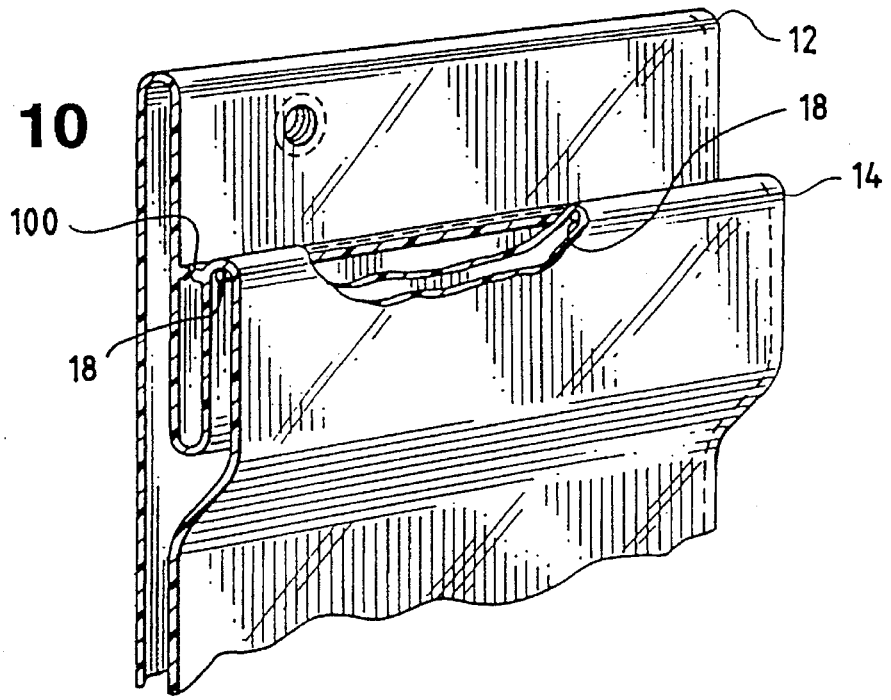
FIG. 10 is an enlarged perspective view of a portion of a reclosable bag illustrating use of a perforated film between a primary and a secondary header according to a preferred embodiment of the present invention.

Likewise, while FIG. 1 illustrates the secondary header 14 being permanently sealed to the primary header 12 at their respective edges, the secondary header 14 may be, alternatively, detachably engaged to the primary header 12. For example, the secondary header may releasably engage the primary header by employing a variety of means such as a peelable seal (e.g., 80 of FIG. 8), a recloseable zipper (e.g., 90 of FIG. 9), or one or more sheets of perforated film (e.g., 100 of FIG. 10). These means of releasable engagement are shown generally in FIG. 2 as a shaded area 25 between the primary header 12 and the secondary header 14.

As an example of a peelable seal to be used as described above, the peelable material used to form the peelable seal may comprise a mixture of four components. First, the peelable material includes a low density polyethylene such as Product No. 412FA manufactured by Westlake Polymers Corp. of Lake Charles, La. Second, the peelable material includes a mineral-reinforcement concentrate such as HM10 manufactured by Heritage Plastics Inc. of Picayune, Miss. Third, the peelable material includes ethylene vinyl acetate (EVA) such as ESCORENE® manufactured by Exxon Chemical Co. of Baytown, Tex. Finally, the peelable material includes polybutylene such as Shell 1560 manufactured by Shell Oil Co. of Houston, Tex. The weight percentages of the foregoing four components of the peelable material preferably are 30% low density polyethylene, 30% mineral-reinforcement concentrate, 20% ethylene vinyl acetate, and 20% polybutylene. The peelable material according to the foregoing mixture has desireable characteristics, which include (1) the ability to provide a bond strength between two and six pounds per lineal inch, and (2) the ability to be heat sealed to another material using a heated seal bar having a temperature ranging from 300° F. to 400° F. and a dwell time ranging from 0.3 to 0.7 seconds.

Referring now to FIG. 3, a perspective view of a recloseable bag 26 according to another preferred embodiment of the present invention is shown. As shown in FIG. 3, the bag 26 comprises a single web of thermoplastic film which is folded so as to form a primary header 28 and a secondary header 30. The bag 10 additionally comprises a containment section 32. A hang hole 34 is located in primary header 28. The hang hole 34 provides a means by which the bag 26 may be hung in a display rack. To assist in opening the bag 26, a tear bead 36 is positioned inside and near the top of the secondary header 30. A recloseable system (see FIG. 4) is also located within the secondary header 30. The side edges and the bottom of the bag 26 are heat sealed as is the area surrounding hang hole 34. These seals hermatically seal the bag 26. In the preferred embodiment of FIG. 3, the side edges of the primary header 28 and secondary header 30 are heat sealed; however, the side edges of the secondary header 30 are not heat sealed to the side edges of the primary header 28. Accordingly, the secondary header 30 is free to move relative to the primary header 28.

As described above with respect to FIG. 1, the bag 26 in the preferred embodiment of FIG. 3 may be manufactured of more than one web of film including more than one type of film.

FIG. 4 is a sectional view of the embodiment of FIG. 3 taken generally along the line 4—4. The recloseable bag 26 comprises a primary header 28 and a secondary header 30, the primary header 28 and secondary header 30 being joined at a juncture 37. The primary header 28 comprises an infold side 38 and a back side 40. The secondary header 30 comprises an infold side 42 and a front side 44. A tear bead 36 is heat sealed to the inside surface of the secondary header 30 near the top. The tear bead 36 is preferably made of a high density polyethylene chord surrounded by a low temperature sealant as described above with respect to FIG. 2. A recloseable system depicted as a recloseable zipper 46 is located near the bottom of the secondary header 30. The recloseable zipper 46 comprises a pair of profiles 48 and 50 which are heat sealed to opposing inside surfaces of the infold side 42 and front side 44 of the secondary header 30, respectively.

Given that the side edges of the secondary header 30 are not heat sealed to the side edges of the primary header 28 and the secondary header 30 is thus free to move relative to the primary header 28; the infold sides 38 and 42 of the primary header 28 and secondary header 30 respectively may be more easily viewed by a person examining the bag 26. As a result, graphic and textual information printed on the infold sides 38 and 42 may be more readily observed. The infold sides 38 and 42 thus provide a greater area for the incorporation of graphics and product information without unduly increasing the overall size of the bag.

FIG. 5 is a cross-sectional view of a recloseable zipper 52 which may be used in the recloseable systems of FIGS. 1–4. The recloseable zipper 52 comprises a pair of profiles 54 and 56 and interlocking lock members 58, 60, and 62. The illustrated recloseable zipper 52 further comprises guide members 64. The profiles 54 and 56, the lock members 58, 60, and 62, and the guide members 64 are preferably made of low density polyethylene and may be manufactured as a single unit or manufactured as separated pieces and subsequently joined together.

The material used to form the reclosable zipper is preferably composed of a mixture of two components. First, the components of the reclosable zipper include a low density polyethylene such as Product No. 412FA manufactured by Westlake Polymers Corp. of Lake Charles, La. Second, these components include ethylene vinyl acetate such as ESCORENE® manufactured by Exxon Chemical Co. of Baytown, Tex. The preferred weight percentages are 90% low density polyethylene and 10% ethylene vinyl acetate. Alternatively, the recloseable zipper components may be composed of Rexene 1206 manufactured by Rexene Corporation of Odessa, Tex. The primary characteristics of these materials are that they bond readily to the thermoplastic film of the bag and they provide a modicum of thermal resistance so that they do not melt while bonding other materials thereto.

The thermoplastic film of the bags of FIGS. 1–4 is preferably composed of two or more layers of material. The outer layer of material is a heat-resistant material such as polyethylene terephthalate (PET), oriented polypropylene, or biaxially-oriented nylon. The inner layer of material is a sealant material such as a combination of low density polyethylene and ethylene vinyl acetate.

Figure 11:
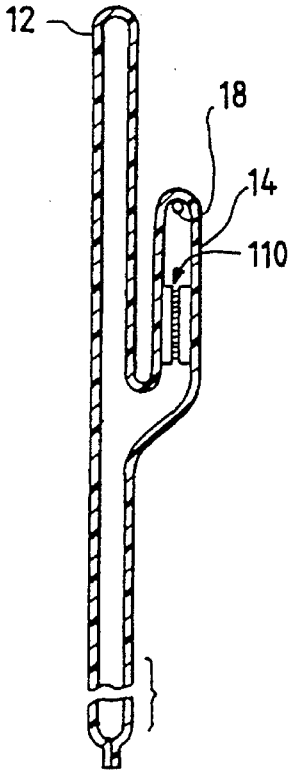
FIG. 11 is a sectional view of the embodiment of FIG. 1 taken generally along the line 2—2 illustrating the use of a pressure sensitive adhesive in a secondary header according to a preferred embodiment of the present invention.

In FIGS. 1–4, the recloseable system has been shown to be located within the secondary header of each illustrated bag. Alternatively, the recloseable system could be located in the containment section of each illustrated bag, preferably near the top of the containment section, such as generally at point 65 of FIG. 1 or point 67 of FIG. 3. Furthermore, although the recloseable systems illustrated in FIGS. 1–4 are recloseable zippers, other types of recloseable systems may be employed such as, for example, a pressure sensitive adhesive type system. A pressure sensitive adhesive type system may comprise, for example, a strip of tacky or adhesive material (e.g., 110 of FIG. 11) applied to one or both of opposing sides of the secondary header or containment section. Likewise, while the tear bead has been illustrated as being attached to the inside surface of the secondary header, the tear bead may alternatively be attached to the outside surface of the secondary header.

Figure 7:
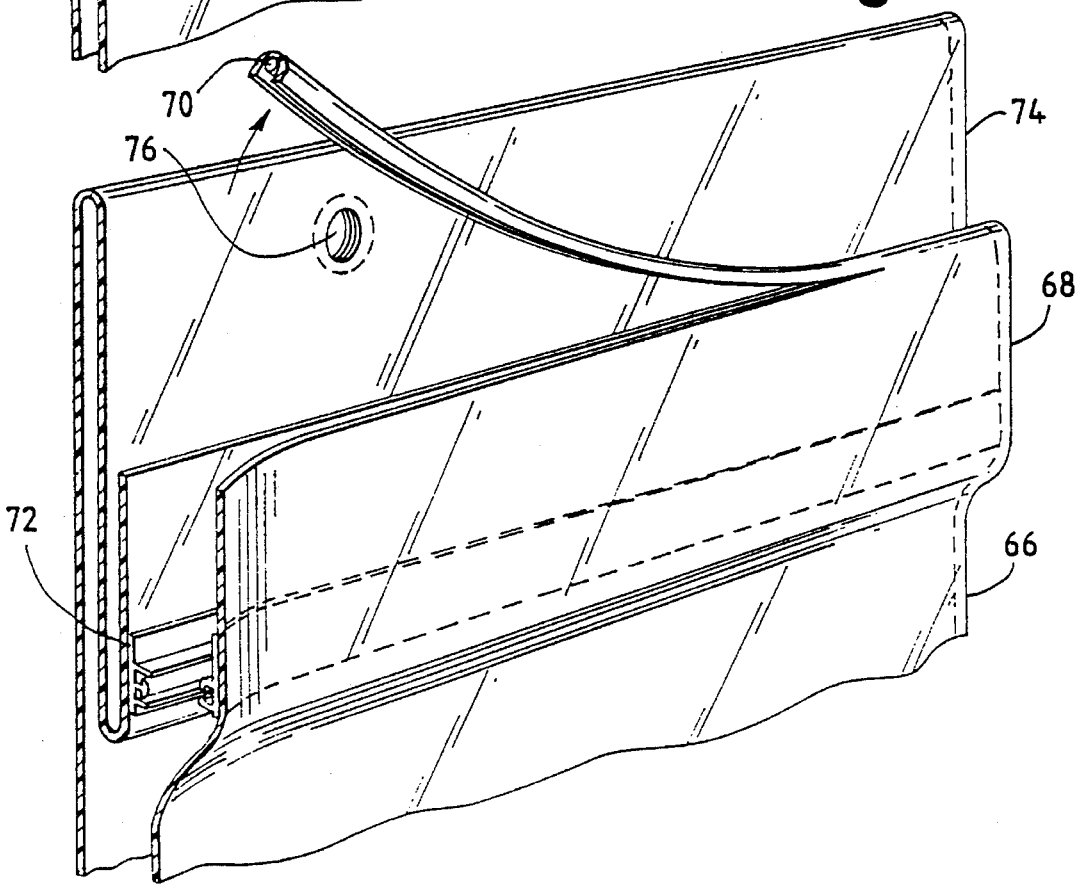
FIG. 7 is a perspective view of a recloseable bag after the seal of the secondary header has been broken.

FIGS. 6 and 7 are perspective views of a recloseable bag before and after, respectively, the seal of a secondary header 68 is broken. FIG. 7 illustrates the breaking of the seal of a secondary header 68 with the aid of a tear bead 70 and the opening of a recloseable zipper 72. Also depicted in FIGS. 6 and 7 is a primary header 74 with a hang hole 76.

While the present invention has been described with reference to several particular embodiments, those skilled in the art will recognize that many changes may be made thereto without departing from the spirit and scope of the present invention. The following claims set forth the scope of the present invention.

What is claimed is:

1. A packaging arrangement comprising:

a web of thermoplastic film folded to form a primary header having a first wall and a second wall and a secondary header having a first wall and a second wall, said first wall of said secondary header being disposed directly adjacent to said second wall of said primary header, said secondary header partially overlying said primary header;

a product containment section positioned below said primary header and said secondary header with no portion of either said primary header or said secondary header overlying any of said product containment portion such that viewing of said product containment section is unobstructed by said primary header and said secondary header, said product containment section having a first wall directly adjacent to said first wall of said primary header and a second wall directly adjacent to said second wall of said secondary header;

a tear bead engaging said secondary header to assist in opening the package arrangement; and a reclosable system attached to the first and second walls of the secondary header to permit the packaging arrangement to be reclosed after it has been opened.

2. The packaging arrangement of claim 1, wherein said recloseable system comprises a recloseable zipper.

3. The packaging arrangement of claim 2, wherein said primary header includes a hang hole.

4. The packaging arrangement of claim 2, wherein said recloseable zipper includes a pair of profiles disposed adjacent and opposite one another, said pair of profiles being configured to interlock with one another over a predetermined length.

5. The packaging arrangement of claim 4, wherein one of said interlocking profiles includes a pair of locking members and the other of said interlocking profiles includes a single locking member releasably engageable between said pair of locking members.

6. The packaging arrangement of claim 1, wherein said packaging arrangement is a polymeric bag.

7. The packaging arrangement of claim 1, wherein said primary header includes a hang hole.

8. The packaging arrangement of claim 1, wherein said recloseable system comprises a pressure sensitive adhesive system.

9. The packaging arrangement of claim 1, wherein said film comprises a single continuous sheet having a leading edge and a trailing edge, wherein said leading and trailing edges are heat sealed together below said product containment section of said packaging arrangement.

10. A packaging arrangement comprising:

a primary header having a first wall and a second wall and a secondary header having a first wall and a second wall, said primary header and said secondary header comprising at least one web of thermoplastic film, said first wall of said secondary header disposed directly adjacent to said second wall .of said primary header, said secondary header partially overlying said primary header;

a product containment section provided below said primary header and said secondary header with no portion of either said primary header or said secondary header overlying any of said product containment portion such that viewing of said product containment section is unobstructed by said primary header and said secondary header, said product containment section having a first wall directly adjacent to said first wall of said primary header and a second wall directly adjacent to said second wall of said secondary header;

a tear bead engaging said secondary header to assist in opening the packaging arrangement; and a reclosable system attached to the first and second walls of the secondary header to permit the packaging arrangement to be reclosed after it has been opened.

11. A packaging arrangement comprising:

a primary header having a first wall and a second wall;

a secondary header having a first wall and a second wall, said secondary header partially overlying said primary header;

a product containment section, said primary header and said secondary header being joined at a juncture between said second wall of said primary header and said first wall of said secondary header and said product containment section being located below said juncture with no portion of either said primary header or said secondary header overlying any of said product containment portion such that viewing of said product containment section is unobstructed by said primary header and said secondary header, said product containment section having a first wall directly adjacent to said first wall of said primary header and a second wall directly adjacent to said second wall of said secondary header;

a tear bead engaging said secondary header to assist in opening the packaging arrangement; and a reclosable system attached to said first wall and said second wall of said secondary header to permit the packaging arrangement to be reclosed alter it has been opened.

12. The packaging arrangement of claim 11, wherein the recloseable system comprises a recloseable zipper.

13. The packaging arrangement of claim 11, wherein said secondary header is unattached to said primary header above said juncture.

14. The packaging arrangement of claim 11, wherein said secondary header permanently engages said primary header above said juncture.

15. The packaging arrangement of claim 11, wherein said secondary header detachably engages said primary header above said juncture.

16. The packaging arrangement of claim 15, wherein said secondary header detachably engages said primary header above said juncture by means selected from the group consisting of a recloseable zipper, a peelable seal, and one or more sections of perforated thermoplastic film which once broken can not be re-engaged.

17. The packaging arrangement of claim 11, wherein said primary header contains a hang hole.

18. The packaging arrangement of claim 11, wherein said primary header, said secondary header, and said product containment section comprise a single continuous sheet of thermoplastic film, said film having a leading edge and a trailing edge, wherein said leading and trailing edges are heat sealed together below said product containment section.

19. A packaging arrangement comprising:

a primary header having a first wall and a second wall;

a secondary header having a first wall and a second wall, said secondary header partially overlying said primary header;

a product containment section, said primary header and said secondary header being joined at a juncture between said second wall of said primary header and said first wall of said secondary header and said product containment section being located below said juncture with no portion of either said primary header or said secondary header overlying any of said product containment portion such that viewing of said product containment section is unobstructed by said primary header and said secondary header, said product containment section having a first wall directly adjacent to said first wall of said primary header and a second wall directly adjacent to said second wall of said secondary header;

a tear bead engaging said secondary header to assist in opening the packaging arrangement; and a reclosable system positioned between the walls of said secondary header to permit the packaging arrangement to be reclosed after it has been opened.

20. The packaging arrangement of claim 12, wherein the recloseable system comprises a recloseable zipper.

21. A reclosable thermoplastic bag comprising:

a primary header having a first wall and a second wall;

a secondary header having a first wall and a second wall, said secondary header partially overlying said primary header;

a product containment section, said primary header and said secondary header being joined at a juncture between said second wall of said primary header and said first wall of said secondary header and said product containment section being located below said juncture with no portion of either said primary header or said secondary header overlying any of said product containment portion such that viewing of said product containment section is unobstructed by said primary header and said secondary header, said product containment section having a first wall directly adjacent to said first wall of said primary header and a second wall directly adjacent to said second wall of said secondary header;

a tear bead engaging said secondary header to assist in opening the reclosable thermoplastic bag; and a reclosable system positioned between the walls of said secondary header to permit the reclosable thermoplastic bag to be reclosed after it has been opened.

22. The reclosable thermoplastic bag of claim 21, wherein said primary header contains a hang hole.

* * * * *